United States Patent [19]

Verhoeven et al.

[11] Patent Number: 4,897,053

[45] Date of Patent: Jan. 30, 1990

[54] CONTACT PIN

[75] Inventors: Robert J. Verhoeven, Sint Amands Aan de Schelde; Danny L. C. Morlion, Gent, both of Belgium

[73] Assignee: Burndy Corporation, Norwalk, Conn.

[21] Appl. No.: 336,410

[22] Filed: Apr. 11, 1989

[30] Foreign Application Priority Data

Nov. 7, 1988 [EP] European Pat. Off. ..... 88202482.1

[51] Int. Cl.[4] ..... H01R 13/428

[52] U.S. Cl. ..... 439/751; 439/82

[58] Field of Search ..... 439/82–84, 439/751

[56] References Cited

U.S. PATENT DOCUMENTS

| | | | |
|---|---|---|---|
| 3,696,323 | 10/1972 | Kinkaid et al. | 339/192 |
| 4,066,326 | 1/1978 | Lovendusky | 339/221 |
| 4,186,982 | 2/1980 | Cobauch et al. | 339/17 |
| 4,443,053 | 4/1984 | Astbury | 439/751 |
| 4,737,114 | 4/1988 | Yaegashi | 439/82 |
| 4,759,721 | 7/1988 | Moore et al. | 439/82 |
| 4,775,326 | 10/1988 | Lenaerts et al. | 439/82 |

FOREIGN PATENT DOCUMENTS

| | | | |
|---|---|---|---|
| 0141492 | 5/1985 | European Pat. Off. | 439/751 |
| 0105044 | 10/1986 | European Pat. Off. . | |
| 0198408 | 10/1986 | European Pat. Off. | 439/82 |
| 891418 | 3/1962 | United Kingdom . | |

*Primary Examiner*—Eugene F. Desmond

*Attorney, Agent, or Firm*—Burtsell J. Kearns

[57] ABSTRACT

A contact pin for a printed circuit board comprises a compliant portion for mounting the contact pin in a hole in the printed circuit board. The compliant portion includes two legs extending in the longitudinal direction of the contact pin and joining a solid contact pin portion at both ends. These legs are twisted into a position in which seen in cross section these legs extend obliquely outwardly before insertion of the contact pin in a hole. The legs are separated from each other by a slot and each solid contact pin portion is provided with a positioning element projecting from the corresponding solid contact pin portion into said slot and being displaced outwardly with respect to the solid contact pin portions.

3 Claims, 1 Drawing Sheet

CONTACT PIN

BACKGROUND OF THE INVENTION

The invention relates to a contact pin for a printed circuit board, in particular a contact pin comprising a compliant portion for mounting the contact pin in a hole in the printed circuit board.

U.S. Pat. No. 3,634,819 discloses a contact pin with a compliant portion having two legs extending in the longitudinal direction and joining a solid contact pin portion at both ends. The legs are displaced outwardly in opposite directions so that the legs are separated by a slot along their whole length. During insertion the legs move towards each other through the slot. Due to the slot the cross section of the legs is decreased and thereby the strength of the legs is also decreased.

U.S. Pat. No. 4,186,982 discloses a contact pin with a compliant portion having two legs extending in the longitudinal direction of the contact pin and joining a solid contact pin portion at both ends. The legs are displaced outwardly in opposite directions wherein the opposite surfaces of the legs are partially overlapping each other along their whole length. During insertion the opposite surfaces of the legs slide along each other along their whole length thereby providing a sliding friction force to be overcome during insertion resulting in a high insertion force. This high insertion force may cause a cold weld between the coating of the hole wall and the coating of the compliant portion of the contact pin. Such a cold weld is disadvantageous because replacement of the contact pin could easily cause an unrepairable damage to the wall of the hole. Moreover, as the diameter of the hole will vary during the lifetime of the printed circuit board due to temperature effects for example, this sliding friction force adversely effects the long term retention force of the contact pin.

Furthermore, due to the frictional engagement of both legs or spring members, the latter do not work independently from each other resulting in an intermittently movement causing a random spring rate. The asymmetrical configuration of the compliant section is responsible for a torsion of the pin ends after insertion, causing damage to the mating socket contact. Although an anti-torsional feature can be built in, as described in U.S. Pat. No. 4,186,982, it is very hard to incorporate this in a miniaturized version (for small holes) without loosing the elastic properties of both legs.

EP-A-0 141 492 discloses a contact pin with a compliant portion having two legs arranged in the same manner as in U.S. Pat. No. 3,634,819. Further a center leg is provided in the slot between the two outer legs which center leg is displaced radially outwardly in order to prevent torsion during insertion. As in the contact pin of U.S. Pat. No. 3,634,819, the strength of the outer legs is decreased by the slot between these legs. The center leg does not attribute to the retention force in a significant manner.

The increasing integration of functions in integrated circuit devices leads to a demand for a higher number of connections on a printed circuit board. Further it is desired to restrict the area available for the contact pins so that more place will be available for the conductor tracks. Therefore it is desirable to use holes with a smaller diameter, for example approximately half of the size of the currently used holes. However, especially for small holes in a printed circuit board, the flexibility of the compliant portion of the contact pin has to be high in order to prevent damages to the plating of the hole. Furthermore sufficient spring strength has to be foreseen in order to provide a sufficient retention force.

With respect to a possible application of the prior art, U.S. Pat. No. 3,634,819 and EP-A-0 141 492, for small holes (0.5 mm) the cross-sectional area of the legs has to be further decreased thereby limiting the springabilities and strength of both legs to such an extent that, insufficient retention force is obtained, whereby an electrical connection is not guaranteed anymore during the lifetime of the system. In view of the small dimensions of the contact pin suitable for such small holes, the force required to overcome any possible friction forces, as appearing in U.S. Pat. No. 4,186,982, could cause overstressing of the legs of the contact pin and damages to the hole. It will be clear that overstressing of the legs results in a low retention force.

SUMMARY OF THE INVENTION

It is a general object of the invention to provide a contact pin adapted for use in small holes.

It is a further object of the invention to provide a contact pin of the above-indicated type with an increased flexibility in combination with a high strength of the legs.

It is a still further object of the invention to provide a contact pin of this type with an improved long term retention force by eliminating friction forces during insertion.

To this end the contact pin according to the invention is characterized in that said legs are separated from each other by a slot and in that each solid contact pin portion is provided with a positioning element projecting from the corresponding solid contact pin portion into said slot and being displaced outwardly with respect to the solid contact pin portions.

In this manner a contact pin is obtained with an increased flexibility of the compliant portion and wherein during insertion into a hole of a printed circuit board friction forces will not occur, whereby the retention force is guaranteed during the lifetime of the system. The positioning elements provide an accurate positioning of the contact pin in the hole before and after insertion.

Preferably the positioning elements are at least substantially contacting the opposite surfaces of the legs in the non-compliant parts thereof. Thereby, the strength of the legs is improved.

BRIEF DESCRIPTION OF THE DRAWINGS

The invention will be further explained by reference to the drawings in which an embodiment of the contact pin of the invention is shown.

DESCRIPTION OF A PREFERRED EMBODIMENT

Figure 1:
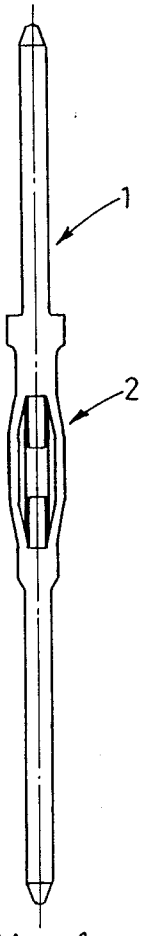
FIG. 1 shows a front view of an embodiment of the contact pin according to the invention.

Referring to FIG. 1, there is shown a contact pin 1 comprising a compliant portion 2 for mounting the contact pin in a hole of a printed circuit board not shown in the drawing. Generally, the hole will be a so called plated through hole provided with a lining of copper or the like which is electrically connected with one or more conductive circuit parts of the printed circuit board.

The compliant portion 2 should be designed in such a manner that at each hole diameter within the tolerance range of hole diameters whereby on the one side a sufficient retaining force is generated and on the other side the lining of the hole and the surrounding area of the printed circuit board are not severely damaged during insertion.

Figure 4:
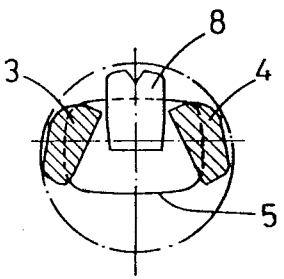
FIG. 4 is a cross section of the compliant portion of the contact pin of FIG. 1.
Figure 3:
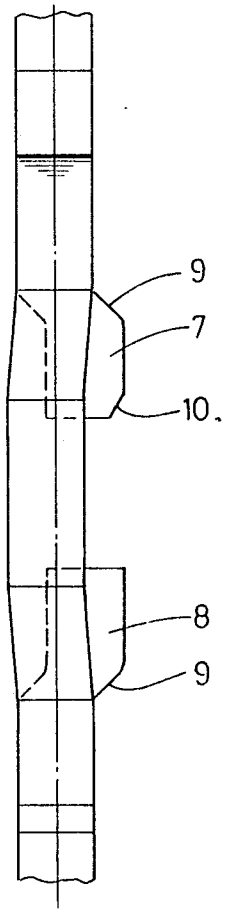
FIG. 3 is a side view of the compliant portion of the contact pin of FIG. 1 on a larger scale.
Figure 2:
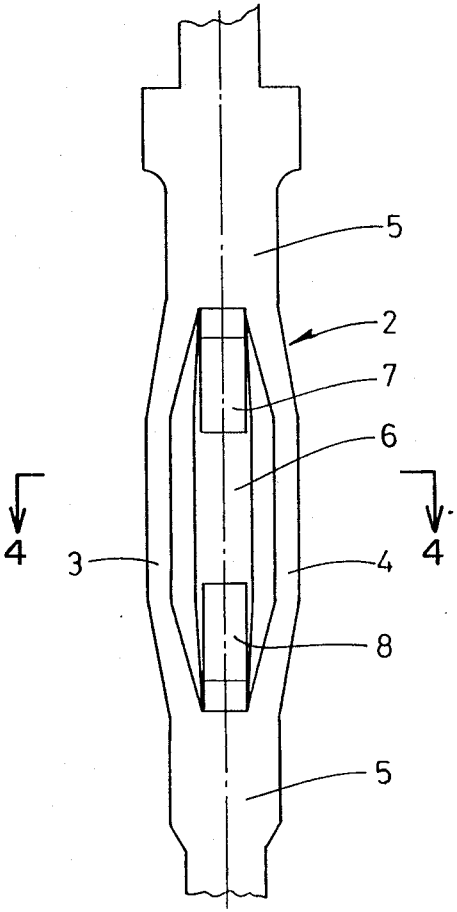
FIG. 2 is a front view of the compliant portion of the contact pin of FIG. 1 on a larger scale.

The compliant portion 2 of the contact pin 1 is shown in more detail in FIGS. 2, 3 and 4. The compliant portion 2 comprises two legs 3, 4 extending in the longitudinal direction of the contact pin and joining a solid contact pin portion 5 at both ends. The solid contact pin portions 5 have a mainly rectangular cross section wherein the corners are rounded as indicated in FIG. 4.

The legs 3, 4 are separated from each other by a slot 6. Each solid contact pin portion 5 is provided with a positioning element 7, 8 projecting from the corresponding solid contact pin portion 5 into said slot 6. Further the positioning elements 7, 8 are displaced outwardly along substantially their whole length with respect to the solid contact pin portions 5. Each positioning element 7, 8 is provided with a guidance surface 9 enclosing an angle of approximately 45° with its outwardly directed surface.

As shown in the drawings, the legs 3, 4 are twisted into a position in which these legs extend obliquely outwardly from the positioning elements 7, 8. The positioning elements 7, 8 are at least substantially contacting the inwardly directed surfaces of the legs 3, 4 in the non-compliant parts thereof joining the solid contact pin portions 5. In other words, the width of the positioning elements 7, 8 is slightly less than or at the utmost equal to the width of the slot 6 and the length along which the positioning elements extend into the slot 6 substantially corresponds with the length of the non-compliant parts of the legs 3, 4. Thereby in the embodiment shown in the drawings, the legs 3, 4 are initially separated from the positioning elements 7, 8 and upon insertion the legs 3, 4 will contact the positioning elements with their non-compliant parts so that the legs 3, 4 are supported by the positioning elements.

Due to the slot 6 between the legs 3, 4 the compliant portion 2 shows a high flexibility, wherein during insertion no friction forces will occur. Thereby overstressing of the legs 3, 4 and damages to the plating of the hole are prevented and the long term retention force is not adversely effected by friction. Since both legs 3, 4 or spring members are acting independently, this design offers a predictable, regular spring rate not disturbed by a random frictional engagement.

The positioning elements 7, 8 provide an accurate positioning of the contact pin in the hole and further favorably attribute to the strength of the legs 3, 4. Further, the positioning elements 7, 8 initialize in a favorable manner the rotational movement of the legs 3, 4 during insertion.

By these features the contact pin 1 is especially adapted to small plated through holes with a nominal diameter of ±0.5 mm.

The rotational movement of the legs 3, 4 guarantee an accurate position of the ends of the contact pin 1 which will not be pivoted out of their original positions by the movement of the legs 3, 4. In this respect reference is made to EP-A-0 225 400 of the same applicant.

As shown in FIG. 3 the upper positioning element 7 opposite of the end of the contact pin 1 to be inserted is provided with a bevelled end face 10 at its free end. Thereby damaging of the wall of the hole by the positioning element 7 is prevented.

In the outwardly directed surfaces of the positioning elements 7, 8 a groove-like recess 11 is provided acting as a receiving space for any material scraped off of the wall of the hole. Further the part of the positioning elements 7, 8 lying between the legs 3, 4 is bevelled at the sides facing these legs. Thereby the torsion movement of the legs 3, 4 is maximized.

It will be understood that the ends of the contact pin 1 can be made in different manners depending on the application of the pin. For example, the contact pin may be a socket contact, an IDC-contact or an edge type contact.

The invention is not restricted to the above-described embodiment which can be varied in a number of ways within the scope of the following claims.

We claim:

1. Contact pin for a printed circuit board, comprising a compliant portion for mounting the contact pin in a hole in the printed circuit board, said compliant portion including two legs extending in the longitudinal direction of the contact pin and joining a solid contact pin portion at both ends, said legs being twisted into a position in which seen in cross section these legs extend obliquely outwardly before insertion of the contact pin in a hole, wherein said legs are separated from each other by a slot and in that each solid contact pin portion is provided with a positioning element projecting from the corresponding solid contact pin portion into said slot and being displaced outwardly with respect to the solid contact pin portions.

2. Contact pin according to claim 1, wherein said positioning elements are at least substantially contacting the opposite surfaces of the legs in the non-compliant parts thereof.

3. Contact pin according to claim 1 or 2, wherein at least the positioning element lying opposite of the end of the contact pin to be inserted is provided with a bevelled end face at its free end.

* * * * *